US007051813B2

(12) United States Patent
Hayes et al.

(10) Patent No.: US 7,051,813 B2
(45) Date of Patent: May 30, 2006

(54) PASS THROUGH VALVE AND STAB TOOL

(75) Inventors: Kirby Hayes, Lloydminster (CA); Tyler Scott, Marsden (CA)

(73) Assignees: Kirby Hayes Incorporated, Lloydminster; Valor Energy Ltd., Marsden ( * ) Notice: Subject to any disclaimer, the term of this patent is extended or adjusted under 35 U.S.C. 154(b) by 251 days.

(21) Appl. No.: 10/792,698

(22) Filed: Mar. 5, 2004

(65) Prior Publication Data

US 2005/0082065 A1 Apr. 21, 2005

Related U.S. Application Data

(60) Provisional application No. 60/511,122, filed on Oct. 15, 2003.

(51) Int. Cl.
*E21B 34/00* (2006.01)

(52) U.S. Cl. ..... 166/332.1; 166/332.4

(58) Field of Classification Search ... 166/332.1–332.4
See application file for complete search history.

(56) References Cited

U.S. PATENT DOCUMENTS 4,501,292 A 2/1985 Maloblocki
4,638,859 A * 1/1987 Zunkel et al. ..... 166/51
4,723,606 A * 2/1988 Vinzant et al. ..... 166/319
4,771,635 A 9/1988 Trevillion
4,848,454 A 7/1989 Spears
5,382,142 A 1/1995 Spears
5,533,876 A 7/1996 Nelson, II
5,642,990 A 7/1997 Short
5,655,604 A 8/1997 Newton
5,890,538 A 4/1999 Beirute et al.
5,941,311 A 8/1999 Newton
6,009,945 A * 1/2000 Ricks ..... 166/242.3

OTHER PUBLICATIONS www.darttsystems.com/valve.html; printed Nov. 18, 2003; see US Patent 5,533,876.

* cited by examiner

*Primary Examiner*—Frank S. Tsay
(74) *Attorney, Agent, or Firm*—Sean W. Goodwin

(57) ABSTRACT

A method and system allows periodic access the wrong way through one or more one-way valves installed in a fluid flow stream. Fluid can flow through the bypassed valves or through the tools used to bypass the valves such as those of a reciprocating production pump. A stab tool cooperates with a valve to unseat a ball from a ball seat so as to bypass the ball and pass through the ball seat. The stab tool can be conveyed by tubing for discharge of fluid through ports in the stab tool. In another aspect of the invention, a rod installed within a pump between a reciprocating uphole valve and a downhole valve is arranged so that when the pump is closed, the stab tool at the rod's lower end passes through the downhole valve and a projection at the rod's upper end passed though the uphole valve the pump is partially closed. Fluid can be pumped in reverse through the pump fluidize debris.

28 Claims, 7 Drawing Sheets

Fig. 3b(ii)

PASS THROUGH VALVE AND STAB TOOL

CROSS REFERENCE TO RELATED APPLICATION

This application claims priority of U.S. Provisional Patent application Ser. No. 60/511,122, filed on Oct. 15, 2003, the entirety of which is incorporated herein by reference.

FIELD OF THE INVENTION

This invention relates to a method and apparatus to periodically bypass a one-way ball-type valve, more particularly to extend a stab tool upstream through the valve for enabling flow therethrough in either direction such as to enable access downhole of one or more valves of a reciprocating production pump.

BACKGROUND OF THE INVENTION

The recovery of fluid from an underground borehole can be accomplished by means of a pumping system to pump the production fluid from the well up to the surface. One such system is a pump-to-surface pump wherein a reciprocating pump is stroked using reciprocating production tubing coupled to a plunger and a barrel containing one-way traveling and standing valves respectively.

On occasion it is desirable to inject or circulate a fluid into areas of accumulated debris or solids, which can be located uphole, downhole and in the production pump. Localized circulation of fluid can fluidize the accumulated solids for clearing blockages or for ease of removal. Technology is currently available to remove debris or solids from areas uphole of the pump, but the area downhole of the pump is generally inaccessible due to the use of the one-way fluid valves in the production string; allowing fluids uphole but preventing flow and access downhole. The valves typically have a ball which engages a ball seat. Fluid flow one way lifts and flows around the ball, and attempted flow in the reverse direction is blocked by seating of the ball on the ball seat. A seated ball also blocks the passing of tools and the like. Thus, blockages or plugging of the pump intake downhole of the valves can necessitate servicing the well to pull the pump with associated loss of production and cost of servicing.

One approach is to use localized mechanical devices for temporarily unseating the ball of a one-way ball valve such as those disclosed in U.S. Pat. No. 5,642,990 to Short; U.S. Pat. No. 5,890,538 to Beirute et al.; and U.S. Pat. No. 5,533,876 to Nelson, II.

More specifically, U.S. Pat. No. 4,848,454 to Spears teaches a downhole tool for use with a specialized ball and traveling valve in a sucker rod-actuated fluid pump for raising petroleum fluids through production tubing. A spring-biased housing connector located in the valve causes movement between an upper and lower housing to jar the ball seat and upward bumping force causing the ball to be moved from its seat to permit the passage of well fluid up through the traveling valve. The jarring apparatus prevents passage of any tool through the ball seat, blocking access below the valve even though the ball has been mechanically knocked off of its seat.

Another reference is U.S. Pat. No. 5,941,311 to Newton which teaches a downhole production tool with at least two dispositions, a usual production mode, and an injection mode in which fluids from the surface are injected down the production tubing through the down-hole tool on an intermittent basis. The system utilizes a lower member or projector which mechanically and temporarily lifts a ball to permit flow through the valve. Again, a tool cannot pass through the valve because the lower projector also blocks the otherwise fluidly-open ball seat. Similarly, further references like U.S. Pat. No. 4,771,635 to Trevillion as well as previously mentioned U.S. Pat. Nos. 5,533,876 and 5,642,990 teach a lower projector type member to temporarily lift the ball from the ball seat, prohibiting devices from passing through the valve. All of these systems rely on relative movement of the either the valve or the projector, such movement which could be restricted or other compromised by debris adjacent the valve area.

SUMMARY OF THE INVENTION

One embodiment of the invention is disclosed that allows the periodic disabling or bypass of a one-way valve in a reciprocating production pump through the combination of a new one-way valve and stab tool. In one aspect, the stab tool can pass the wrong way through the one-way valve to access a downhole region below a valve or a series of valves in a pump. Fluid can be discharged into the downhole region via ports in the stab tool to fluidize debris and solids that have accumulated and have caused the intake of the pump to be plugged off. As necessary, a stab tool affixed to the end of an endless tubing unit (ETU) can be used to circulate air or foam into the tubing to relieve hydrostatic pressure on the valves for easing unseating of the ball from the valve seat. In another aspect the stab tool disables the one-way valve for enabling reverse flow of fluid directly through the valve.

Accordingly, in one broad aspect of the invention, a system allows periodic access or flow the wrong way through a fluid one-way valve installed in a fluid flow stream. The system comprises a stab tool and a valve housing with a ball seat and a ball. At least a portion of the bore of the valve housing is able to receive an unseated, displaced ball and a stab tool which extends through the valve. The stab tool and more preferably a shaped nose can unseat the ball from the ball seat so as to enable the stab tool to bypass the ball and pass through the ball seat.

More preferably, the system further comprises a conveyance means such as tubing or tensile connector for conveying the stab tool to the valve. The stab tool is attached to an end of the conveyance means and the tool and conveyance means are able to pass through the ball seat of the valve. Fluid from conveyance tubing can be discharged through ports in the stab tool to fluidize debris that have accumulated in the pump and which can cause plugging of the pump intake.

In another aspect of the invention, a method to remove debris from an annulus downhole of a reciprocating pump implementing one-way fluid valves comprises conveying a stab tool via a conveyance means into an uphole one-way valve, unseating a ball of the valve with the stab tool and passing the stab tool through the uphole valve, thereby overcoming the one-way characteristic of the valve. Repeating this conveyance of the stab tool through a series of one-way valves allows access below even a series of one-way valves, such as for the introduction and circulation of fluid through the ports in the stab tool to a point below the valves for fluidizing debris below the valves and below pump as desired.

In yet another aspect of the invention, a system allows periodic disabling or reverse fluid access through a pair of one-way valves installed in a fluid flow stream and movable relative to each other, the system comprising a rod installed within between the pair of valves such as an upper traveling valve and lower standing valve of a reciprocating pump. A projection is affixed to an upper end of the rod and the stab tool is affixed at a lower end of the rod. Normally, such as during a pumping downstroke, the traveling valve moves towards and then away from the standing valve without interference from the rod. However, when the normal pumping downstroke is exceeded, such as to close the pump, the stab tool pass through the standing valve and the projection extends through the traveling valve as it is lowered. Both one-way traveling and standing valves are defeated and fluid can be circulated through the pair of valves the wrong way. Optionally, tubing and a second stab tool can be lowered through the valves and past the rod to clean debris which interferes with the operation of the rod embodiment.

BRIEF DESCRIPTION OF THE DRAWINGS

FIG. 2*a* shows the stab tool being conveyed downhole through the production tubing via coiled tubing, the tool being positioned to unseat the ball in a first uphole one-way valve;

FIG. 2*b* shows the stab tool passed through the first uphole valve and approaching a second downhole one-way valve;

FIG. 2*c* shows the stab tool lowered through all the valves and the pump, in a position to fluidize the debris and solids at the pump intake;

FIG. 2*d* shows the stab tool removed from the production string, the debris fluidized and more able to be circulated out of the annulus;

FIG. 2*e* shows well fluids pumping at an improved rate;

FIG. 3*b*(*ii*) is an alternative top view of the valve of FIG. 3*a*, depicting an alternative ball stop;

FIG. 5*a* shows a rod permanently linked to the reciprocating portion or piston of the pump, a stab tool attached to a lower end of the rod and forming a projection at an upper end;

FIG. 5*b* shows the piston lowered sufficiently such that the stab tool can pass through the series of downhole valves;

FIG. 5*c* shows the piston lowered a further distance such that the uphole valves are lowered over the projection;

FIG. 5*d* shows the pump in a normal reciprocating pumping motion, the piston being the extreme upstroke position;

FIG. 5*e* shows the pump in the normal reciprocating motion pumping, the piston in the bottom downstroke position;

DETAILED DESCRIPTION OF THE PREFERRED EMBODIMENT

Figure 1:
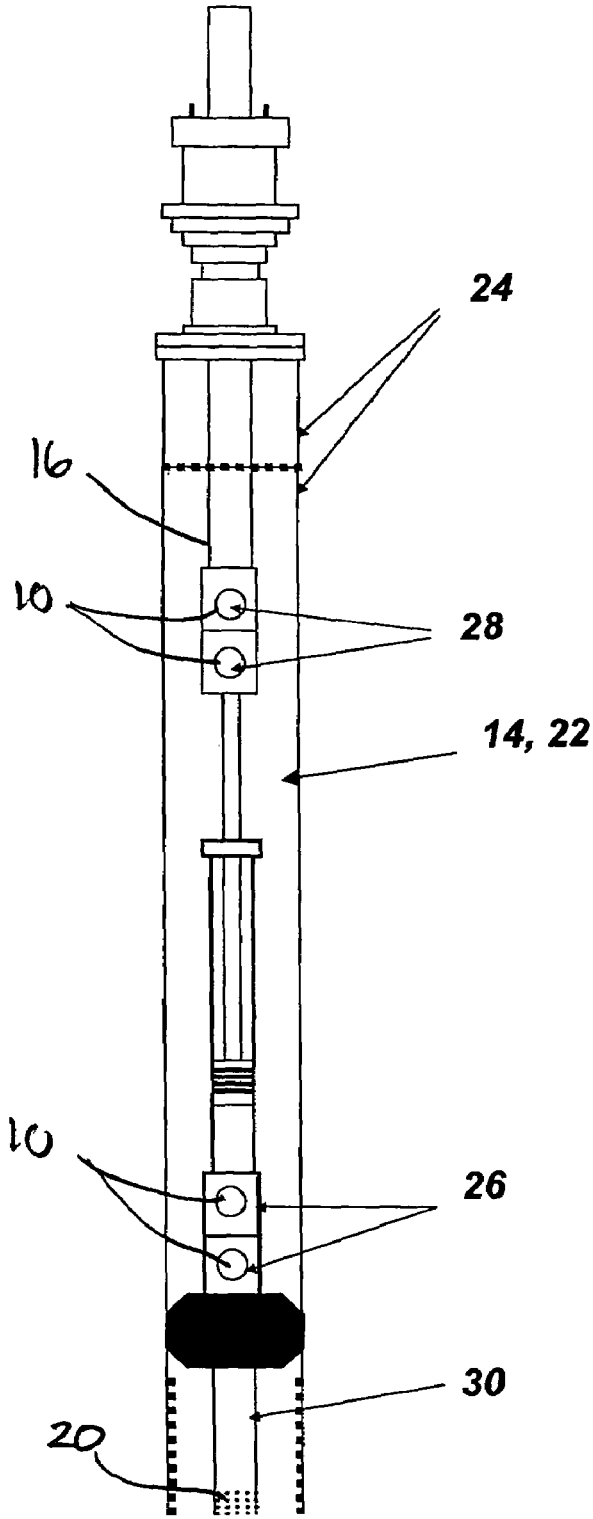
FIG. 1 is a typical set-up for a reciprocating pump utilizing a series of one-way valves.
Figure 2:
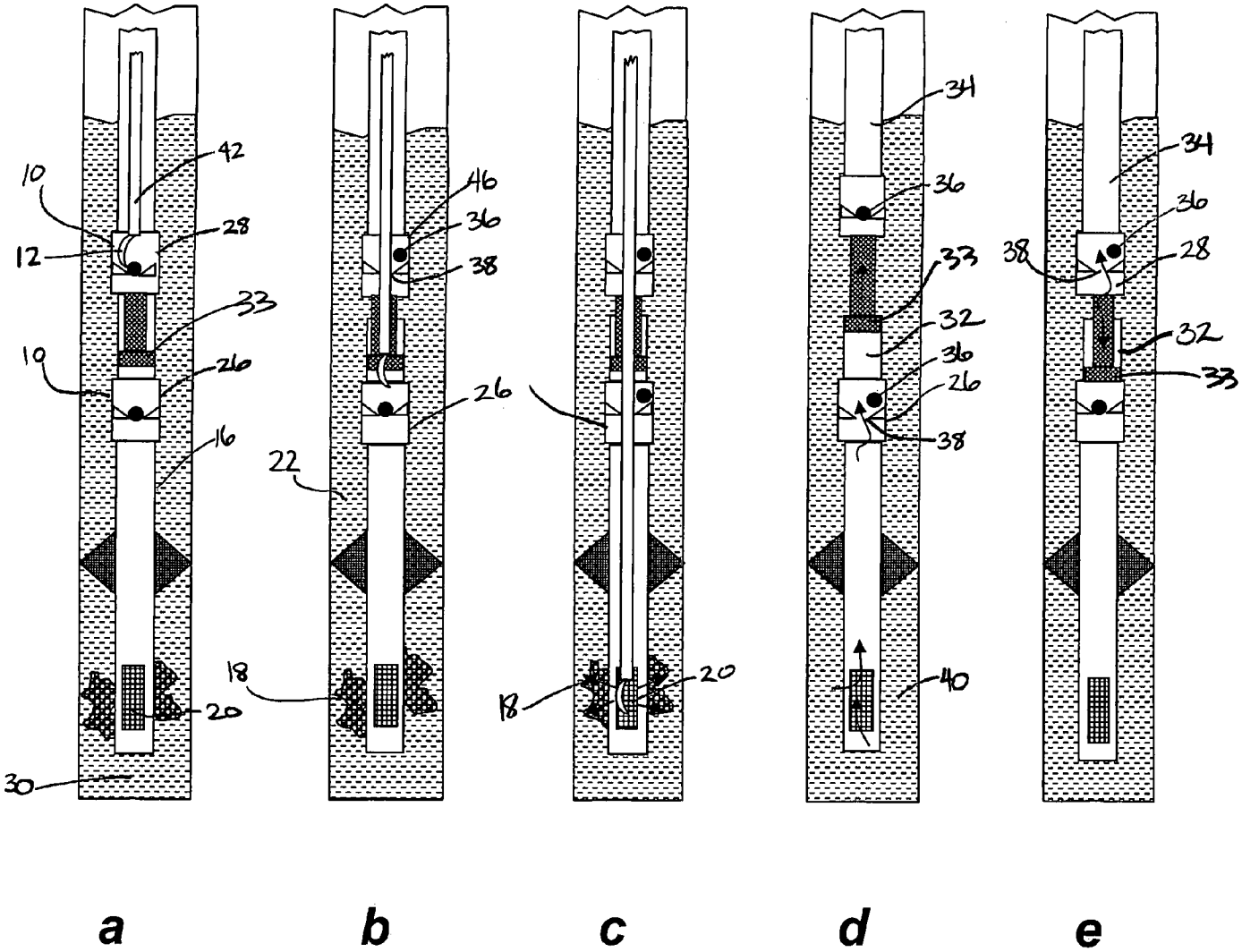
FIGS. 2*a*–2*e* illustrate in schematic form, various stage of operation using one embodiment of the invention. More particularly.

In a preferred embodiment, and with reference to FIGS. 1 and 2*a*, a one-way valve 10 is combined with a stab tool 12 to allow periodic and wrong way access through the one-way valve 10; in a direction opposite to the usual fluid flow. One-way valves can include check valves, ball valves, traveling or standing ball valves or other similar valves.

With reference to FIG. 1, in one embodiment of the invention, the stab tool 12 is employed to access a wellbore 14 downhole of a pump-to-surface production pump 16 so as to relieve a blockage of debris 18 in the vicinity of the pump's intake 20. In this context, a typical reciprocating pump 16 set-up is shown with suitable one-way valves 10 already in place or retrofit according to the present invention. The pump 16 is installed down the wellbore 14, the pump 16 forming an annulus 22 between itself and a well casing 24. The pump 16 has standing and traveling ball valves 26,28. The standing and traveling valves 26, 28 are one-way valves 10 wherein fluid from downhole of the pump and upstream of the valves 10 is directed downstream and uphole, typically to surface for recovery. One cannot conventionally pass a tool down through the valves 10 from the downstream or uphole side of valves, making inaccessible a downhole region 30 below the pump 16 which can be subject to plugging.

With reference to FIGS. 2*a*–2*e*, valves 10 of an embodiment of the invention are installed in the pump 16, the standing and traveling valves 26,28 operating as normal one-way valves 10 to alternately pass fluid uphole and block fluid flow downhole. Conventionally, each of the standing valves 26 and traveling valves 28 can operate singly as shown in FIGS. 2*a*–2*e* or in sets of multiples, two of each being shown in FIG. 1 and FIGS. 5*a*–5*e*.

As shown in FIG. 2*d*, on an upstroke, a pump barrel 32 normally fills with well liquids through the standing valve 26 while contemporaneously lifting a previous pumping cycle's liquid in a pump piston 33 above the traveling valve 28 and becomes stored in production tubing 34. As shown in FIG. 2*e*, on a downstroke, liquid in the pump barrel 32 is displaced through the traveling valve 28 and into the piston 33 and production tubing 34 for the next lift cycle.

The valves 26,28 operate alternately, on the upstroke, a ball 36 of the traveling valve 28 is closed and the ball 36 in the standing valve 26 lifts from a lower ball seat 38, allowing fluid from a reservoir 40 to flow into the barrel 32 of the pump 16. On the downstroke, the ball 36 in the standing valve 26 closes and the ball 36 of the traveling valve 28 lifts from the upper ball seat 38, allowing fluid into the production tubing 34.

As shown in FIGS. 2*a*–2*e*, in order to access the downhole region 30 below the pump 16, the reciprocating motion of the pump 16 is interrupted so that the stab tool 12 can be lowered, on a conveyancing means such as coiled tubing, through the production tubing 34 to pass through the traveling and standing valves 28,26. The stab tool 12 is attached to the end of a conveyance means 42, for lowering the tool 12 downhole. Simply, as the stab tool 12 is lowered, the stab tool 12 displaces or unseats each ball 36 from its respective ball seat 38 sufficiently to enable the stab tool 12 to pass therethrough.

In the experience of Applicants, sometimes, but not always, there can be a significant pressure differential formed by hydrostatic head in the tubing compared to the annulus or well below the pump. This situation is likely related to the final resting position of the pumping stroke when shut down and the condition of the pump. In such cases it could be difficult to unseat the balls of the bottom valve 26 and possibly one or more of the uphole valves 28. It may be necessary to relieve this pressure differential before unseating the valve balls 36. This can be accomplished using an endless tubing unit with the stab tool attached to the downhole end. Known low density fluids including air or foam can be injected to evacuate or lighten the tubing hydrostatic load before passing the stab tool 12 through the valves 28,26.

Figure 3B:
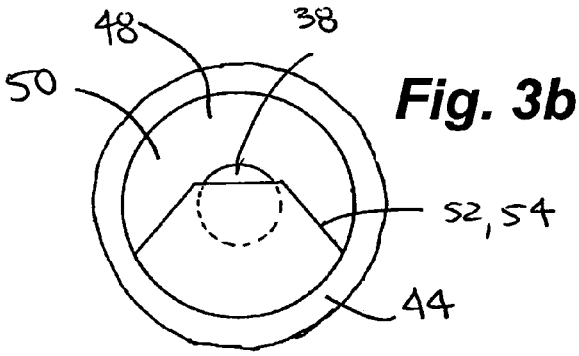
FIG. 3*b*(*i*) is a top view of the valve of FIG. 3*a*, depicting an upper guard or ball stop to retain an unseated ball within the bore of the valve housing.
Figure 3A:
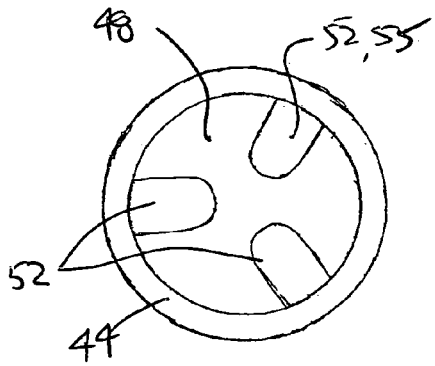
FIG. 3*a* is a side cross-sectional view of a valve of the present invention indicating a preferred embodiment of the ball and ball seat.
Figure 3A:
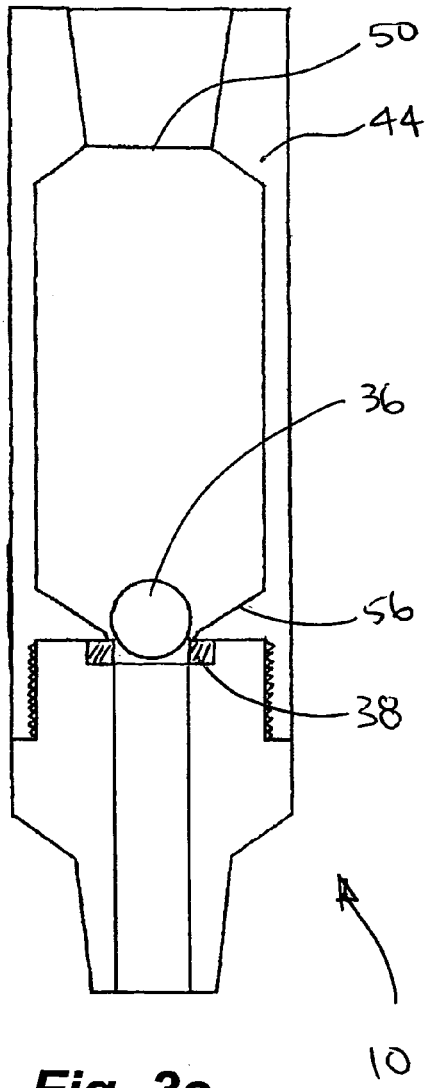
Figure 3C:
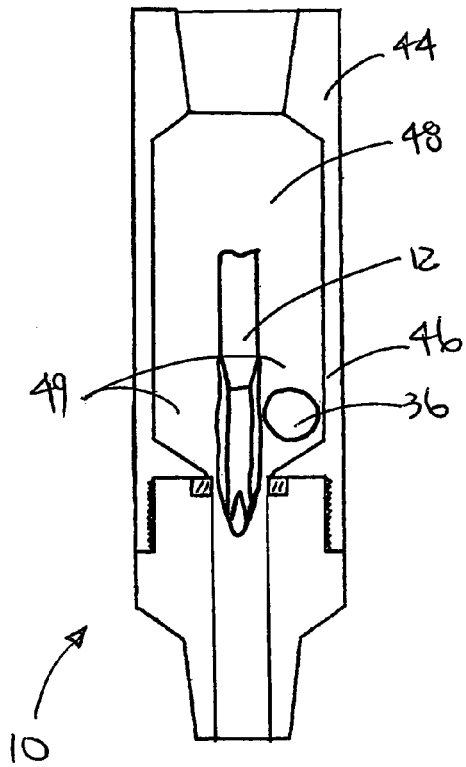
FIG. 3*c* is a cross-sectional view of the valve and front view of the downhole tool passing through the ball seat via coiled tubing after the ball has been unseated by the tool.

With reference to FIGS. 3*a*–3*c* in greater detail each valve 10 comprises a valve housing 44, the ball seat 38 and the ball 36 downstream of the ball seat 38. While the ball 36 is easily lifted from the ball seat 38 from the upstream side using prior art techniques such as a projector from below, there are circumstances when the ball 36 must be displaced from downstream or above the ball seat 38 such as to pass the stab tool 12 thereby.

As shown in FIGS. 2*a*, 2*b* and 3*a*, the ball 36 rests on the seat 38 until the stab tool 12 is conveyed to the ball 36 and at FIG. 2*c* forces the ball 36 off the seat 38. The ball 36 is unseated and displaced substantially laterally in towards a housing wall 46. A bore 48 of the housing 44 is sized to house the ball 36 adjacent to the stab tool 12 as it passes through the ball seat 38. As shown, an annular space 49 is formed about the stab tool 12 in the housing 44 substantially all of which is available to receive the ball 36. Alternatively, an offset pocket may be formed (not shown) to receive the ball 36. Further, the ball seat 38 is shown as concentric with the housing 44, however, the ball seat 38 could also be offset and thereby economize on the overall dimensions of the housing 44.

As shown in FIGS. 3*b*(*i*) and 3*b*(*ii*), an upper region of the valve 50 comprises stop means 52 to prevent loss of the ball 36. Such stop means 52 include a cage 54 as shown in FIGS. 3*b*(*i*) or tabs as shown in FIG. 3*b*(*ii*), which retain the ball 36 in the bore 48 of the housing 44 when either displaced by fluid flow, or when the ball 36 is displaced by the stab tool 12, as shown in FIG. 3*c*. The bore of the housing 44 about the cage 54 is sufficient to permit passage of the stab tool 12 thereby.

The valve 10 and stab tool 12 are sized for the pump 16 requirements. Further, the valve housing 46 and its bore have a diameter sufficient to accommodate both the ball 36 and the stab tool 12 side-by-side, as the stab tool 12 passes through the ball seat 38. Preferably, the ball seat 38 further comprises an angled approach 56 from the housing wall 46 to the seat 38 for aiding in urging a reseating of the ball 36 in deviated or slant well conditions and further for assisting in guiding the stab tool 12 to the ball seat 38. In case of highly deviated wells the angle is preferably greater. As the angle increases, the annular space decrease and the stab tool 12 will have smaller diameter to unseat the ball. Typically, as shown, the angle of the approach 56 is about 60 degrees from a centerline of the valve 10.

As well, a person of ordinary skill in art can set forth a variety of configurations for the ball 36 and seat 38 which can be of any size that permits the ball 36 to sufficiently seat and be unseated relative to the shape and size of the stab tool 12 as well as to an angle from the seat 38 to the housing wall 46.

Figure 4A:
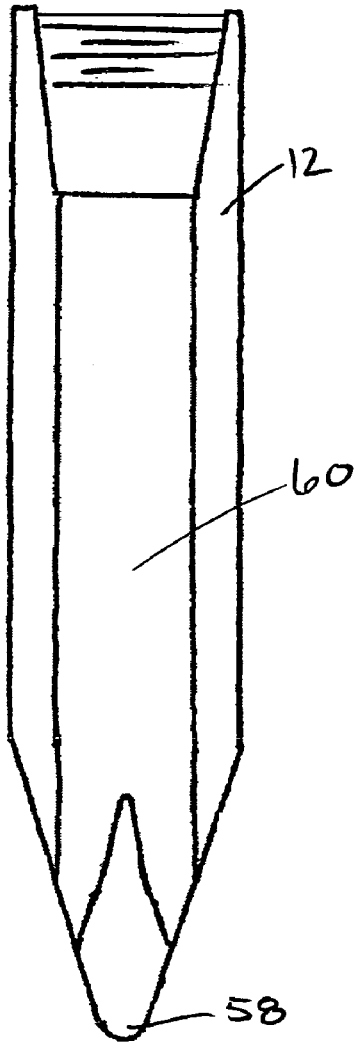
FIG. 4*a* is a larger version of the front view of the downhole tool.
Figure 4B:
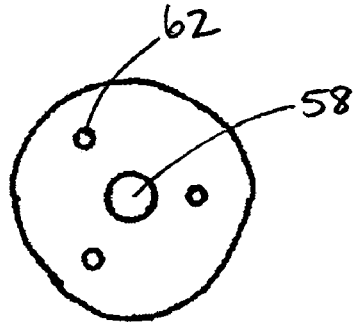
FIG. 4*b* is a bottom view of the stab tool showing ports through which fluid can be forced.
Figure 4C:
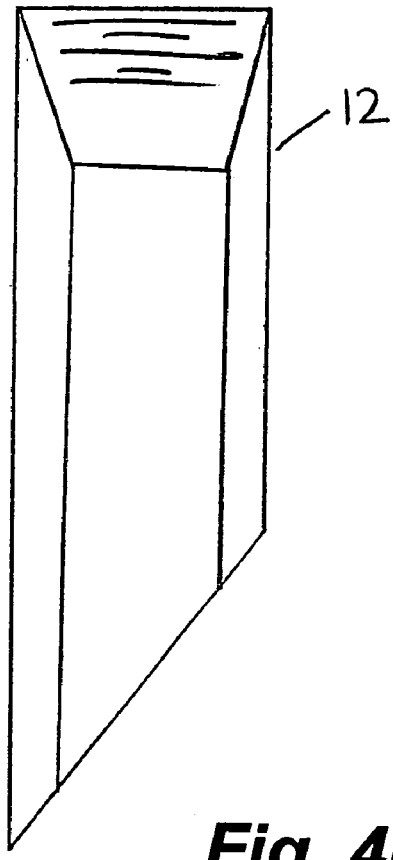
FIG. 4*c* is a front cross-sectional view of an alternate embodiment of the invention.

With reference to FIGS. 4*a*–4*c*, the stab tool 12 has a nose portion or nose 58 which is conveyed to and adjacent the ball 36 for forming an unseating moment which displaces the ball 36 from the ball seat 38. Various geometries of the valve housing 44, ball 36, angled approach 56 and stab tool 12 for enabling displacing of the ball 36 can be determined by those of ordinary skill in the art.

Figure 5:
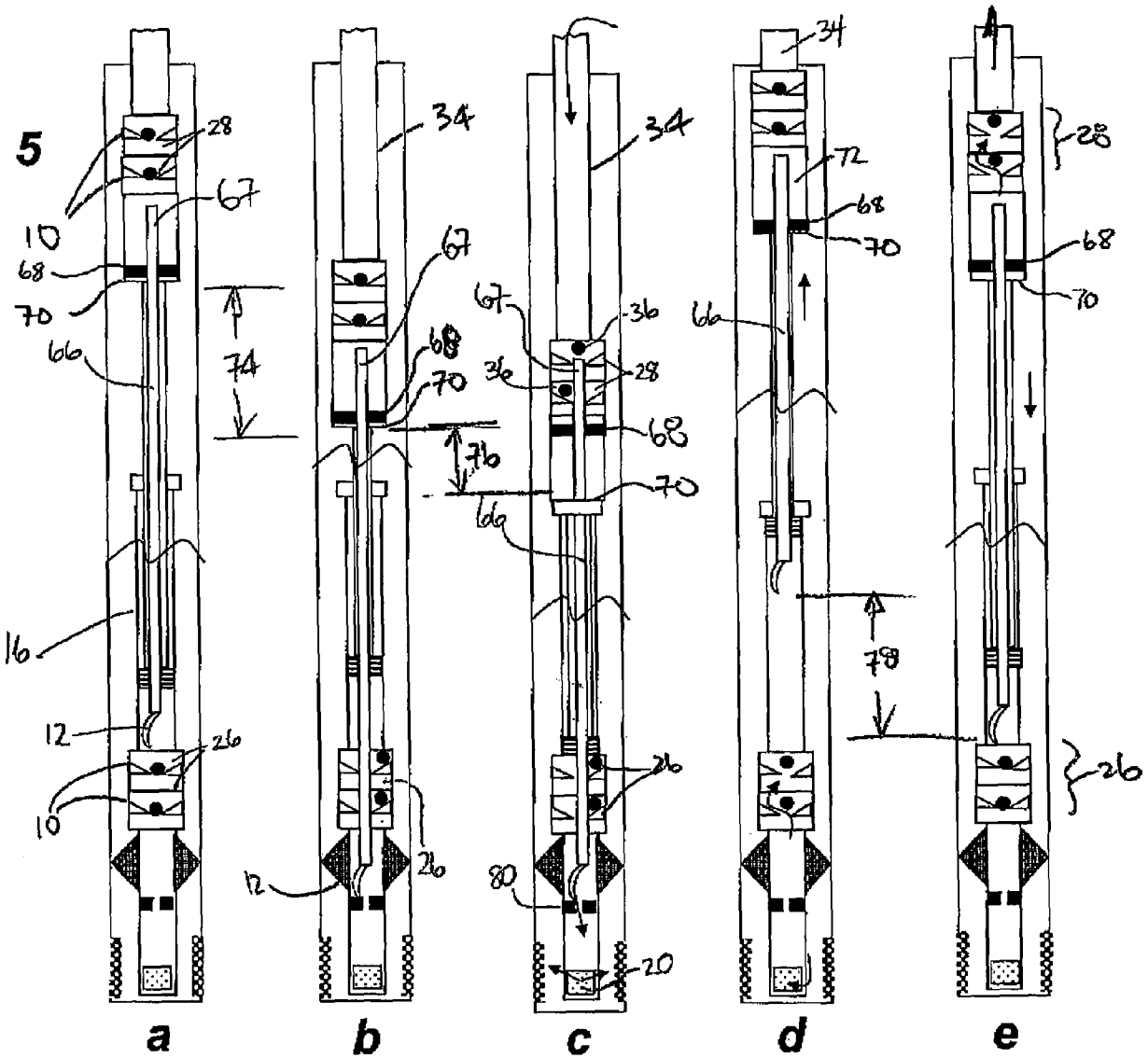
FIGS. 5*a*–5*e* are schematic diagrams illustrating stages of operation of an alternate embodiment of the invention, specifically.

The nose 58 of the stab tool 12 is configured such that it cooperates with the ball 36 for nudging and unseating the ball laterally off of the ball seat 38. The preferred shape of the nose 58 is such that the tool 12 is less likely to contact directly on top of the ball 36 and be stopped thereby. Practically, a second conveying attack of the nose 58 to the ball 36 will generally result in an unseating. More preferably, the nose 58 is preferably oriented laterally to the stab tool 12 for approaching a side of the ball 36 for applying lateral forces and urging the ball from the ball seat 38. Such orientations include a narrowing of the leading edge of the stab tool along the nose 58. The nose 58 can assume a shape of a wedge, conical, concave curved, convex curved and combinations thereof. One shape of the stab tool 12 shown in FIG. 4*c* is a wedge shape which can be exaggerated into a concave spoon-shape as shown in FIGS. 2*a* and 5*a*. Another shape is a narrowing convex or round-nose as shown in FIGS. 4*a* and 4*b*.

For conveying the stab tool 12 to the valve 10, such through a wellbore to a downhole pump 16, a conveyancing means 42 is used such as tubing (not shown). Dependent on the operations, the conveyancing means 42 include coiled tubing, an endless tubing unit or jointed tubing for enabling fluid flow therethrough, or jointed rods, continuous rods, slick line, or wireline when mere positioning of the stab tool is desired.

In many instances fluid flow is useful and accordingly the stab tool 12 has a fluid bore 60, contiguous with a fluid bore in the conveyancing means 42 through which flushing fluids may be directed such as that used to direct flushing fluid downhole through ports 62 formed the stab tool 12.

In a preferred embodiment, a method to remove debris 18 and solids from the annulus 22 downhole of a production pump 16 utilizes the above described system. Over time, produced debris 18 can collect at the intake 20 of the pump 16.

With reference again to FIGS. 2*a*–2*e* and in operation, the stab tool 12 is lowered down through the production tubing 34 to the one-way traveling valve 28 (FIG. 2*a*). The stab tool 12 is conveyed downhole by conveyance means 42 such as endless tubing. As shown at FIG. 2*b*, and by applying force with the stab tool 12 the ball 36 is forced out of the seat 38 and is unseated from the ball seat and is displaced to the housing wall 46 enabling the stab tool 12 to bypass the ball 36 and extend through the ball seat 38 to access the second or standing valve 26. Each of the traveling and standing valves 28,26 can be represented by one or more valves 10 in series.

As shown in FIG. 2*c*, the stab tool 12 similarly passes through the ball seat 38 of the standing valve 26. Any number of valves 10 may be used in series and this process would continue until a blockage is reached or all the valves 10 had been passed through. Once the standing valve 26 of the pump 16 has been passed, the stab tool 12 can be lowered further to access the pump intake 20 region containing a blockage. Fluid is pumped, or otherwise conveyed, down the conveyance means 42 for discharge through the ports 62 in the stab tool 12. Discharge of fluid out of the stab tool 12 can displace or fluidize debris 18 that may have caused the intake 20 of the pump 16 to the plugged off. The debris 18 or solids can be recovered along with regular production fluids.

An alternate embodiment of the invention is shown in FIGS. 5*a*–5*e*. Applicant recognizes that the ability to open a one-way valve 10 at will without conveying a tool down a wellbore enables a pump 16 to be flushed at will merely using fluid pumped from surface. To effect such control, principles of the prior art and the new valves are combined to bypass both the traveling and standing valves with apparatus contained with in the pump 16.

In this embodiment, a rod 66 is permanently installed within the reciprocating pump 16, sandwiched between the upper traveling valve 28 and the lower, standing valve 26. A projection 67 is affixed at an upper end of the rod 66. The stab tool 12 is affixed at a lower end of the rod 66. During normal pumping action, for example utilizing only about 8 feet of a 12 foot stroke, as shown in FIGS. 5*d*,5*e* as normal downstroke distance 78, the rod 66 idly rises and lowers with the upstroke (FIG. 5*d*) and downstroke (FIG. 5*e*) of the pump 16 without interfering with the standing valve 26.

The rod 66 remains neutral within the pump 16 with the aid of means to support the rod in the reciprocating pump. As shown in FIG. 5*a*, support means such as tabs 68 on the rod 66 cooperate with stops 70 formed in a rod housing 72 movable with and below the traveling valve 28. The tabs 68 normally support the rod 66 to hang supported from the stops 70 so that the projection 67 at upper end of the rod 66 remains spaced and clear of the traveling valve 28 and so that the stab tool 12 is supported above the standing valve 26 allowing both valves 28,26 to open and close normally with cyclical upward fluid flow.

To bypass the valves 28,26, the pump 16 is closed by lowering the traveling valve 28. While closing of the pump is typically a single action, it is discussed in sequence to illustrate the bypassing action of each of the two valves 10. Depending upon practical factors such as fluid dynamics and interferences, the projection 67 may initially bypass the traveling valve 28, or the stab tool 12 may initially bypass the standing valve 26; regardless of the order both the traveling and standing valves are ultimately bypassed.

As shown in FIG. 5*b*, in one possible scenario, the arrangement of the pump 16, rod 66 and stab tool 12 results in bypassing of the valves 28, 26 through lowering the traveling valve 28 a first incremental closing distance 74 which allows the stab tool 12 to pass through the standing valves 26 as discussed above while the rod 66 is still nominally supported on the tabs 68. As shown in FIG. 5*c*, the pump 16 can now be lowered a further second incremental closing distance 76 to fully close the pump. Means such as a bottom stop 80 is positioned, such as below the standing valves 26, to contact and support the stab tool 12 forcing the rod tabs 68 and rod 66 to separate from the tab stops 70 enabling the traveling valve 28 to settle over the projection 67 at the upper end of the rod 66 and lift the balls 36 and open the traveling valve 28.

With reference to FIG. 5*c*, after the traveling and standing valves 28,26 have been opened and bypassed using the rod 66, fluid can now be pumped down the production tubing 34 and past the rod 66 and stab tool 12 to fluidize any produced debris 18 which may be blocking or plugging the intake 20 to the pump 16.

Figure 6:
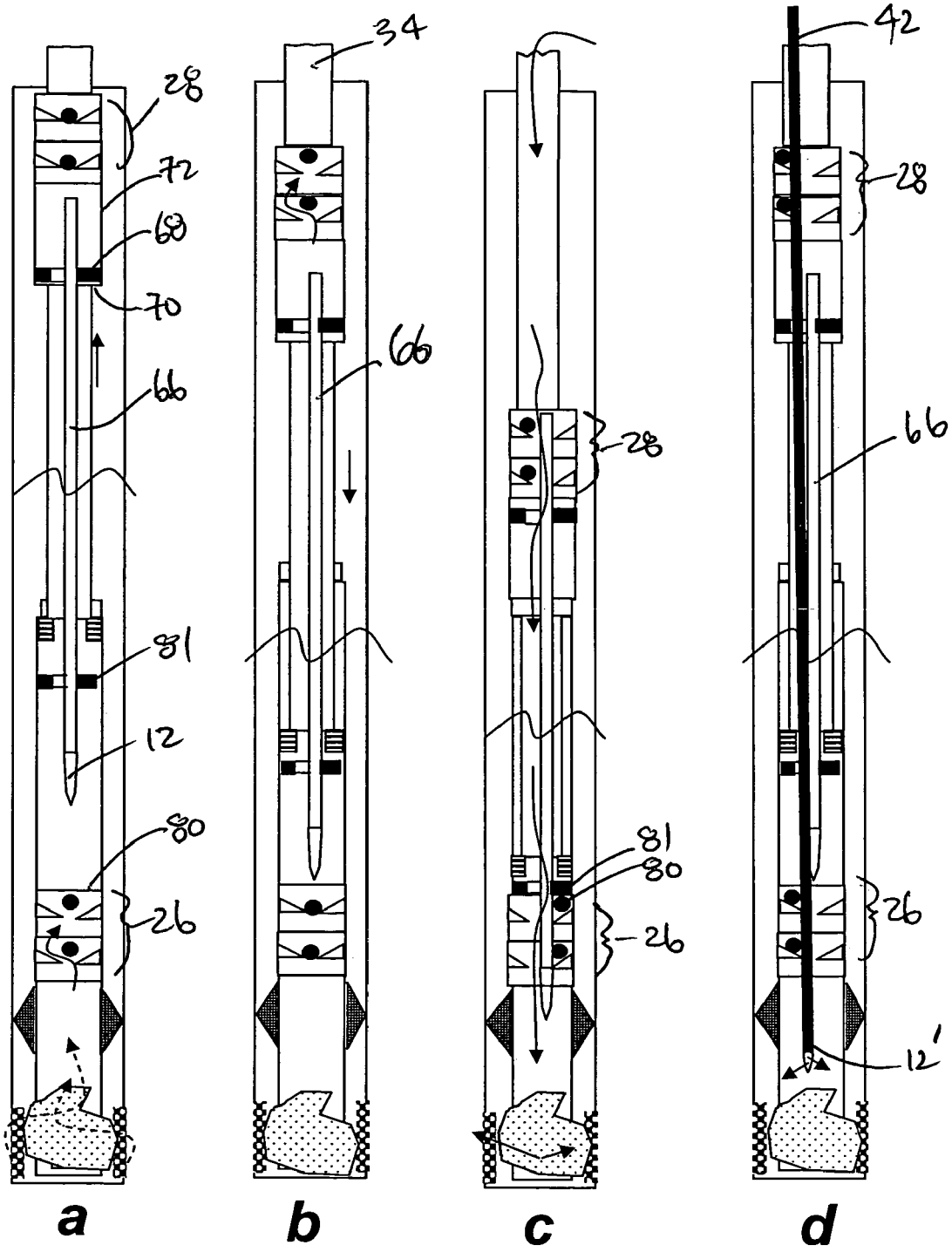
FIGS. 6*a*–6*d* are schematic diagrams illustrating three stages of operation of an alternate embodiment of the invention, specifically normal stroking open position, normal stroking closed position, a fully closed bypassed position and an attempted fully closed bypassed position wherein assistance of a stab tool on a conveyance means is required to assist the rod action.

With reference to FIGS. 6*a*–6*c*, a variant of the arrangement of the pump of FIGS. 5*a*–5*e* illustrates flexibility in means provided to support the rod 66. As shown, and similar to the previous embodiment of FIG. 5*d*, the rod 66 is supported with tabs 68 which cooperate with the stops 70 formed the rod housing 72, normal pump stroking enabled as shown in FIGS. 6*a* and 6*b*. However, instead of providing bottom stop 80 below the standing valves as in FIG. 5*b*, the bottom stop 80 is positioned above the standing valves 26 and tabs 81 to contact and support the rod 66, intermediate the closing of the valve, forcing the rod tabs 68 and rod 66 to separate from the tab stops 70 and again enabling the traveling valve 28 to settle over the projection 67 at the upper end of the rod 66 lift the balls 36 and bypass the traveling valve 28.

In either embodiments shown in FIGS. 5*a*–5*e* and FIGS. 6*a*–6*c*, there is a possibility that debris may block the mechanical penetration of the stab tool 12 through the standing valves 26 and thus defeat the objective of a built-in valve bypass arrangement.

With reference to FIG. 6*d*, in such instances, it is advantageous to additionally employ the first embodiment of the invention and provided a second stab tool 12' on tubing 42. This second stab tool 12' is directed through to the pump and fluids circulated for clearing debris ahead of the tool 12'. In FIGS. 6*a*–6*d*, as also is the case in the embodiment according to FIG. 5*a*, the rod 66 has flow area thereabout for normal pumping action. The second stab tool 12' and tubing are lowered through the traveling valves 28, to the standing valves 26, clearing any debris and then passing through the pump.

Figure 7A:
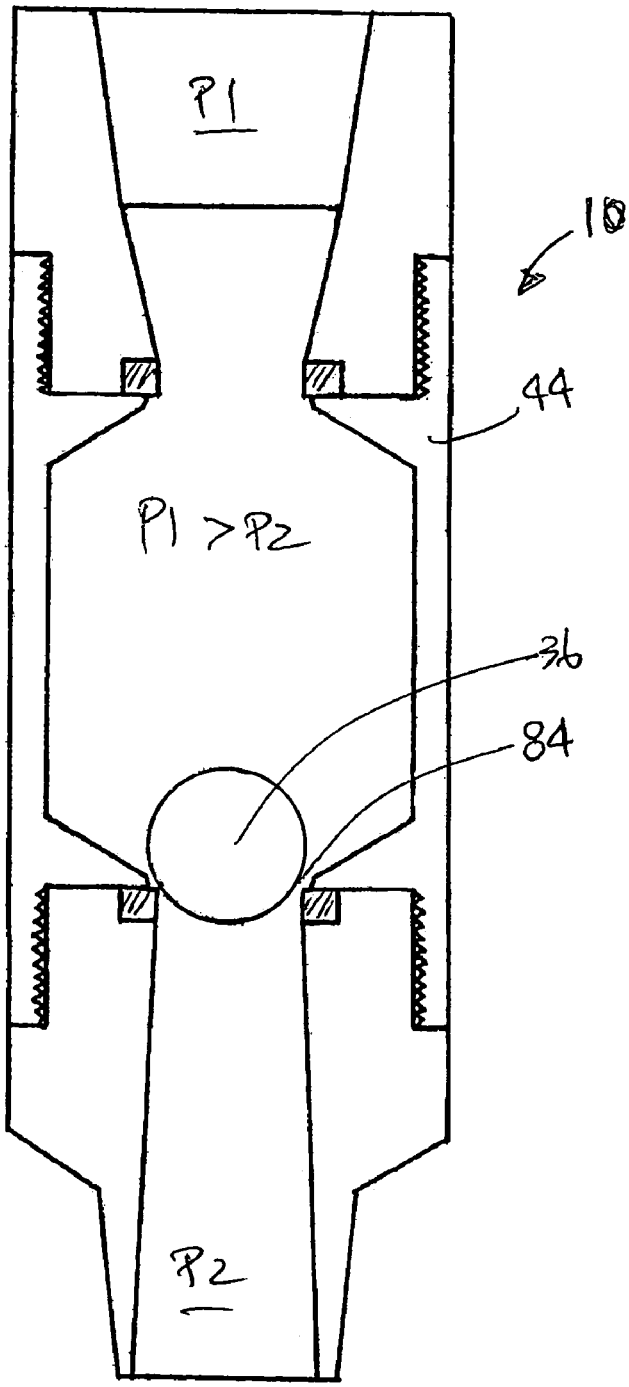
FIG. 7*a* is a cross-sectional view of an alternate embodiment of the valve indicating upper ball seat and a ball on a lower ball seat.
Figure 7B:
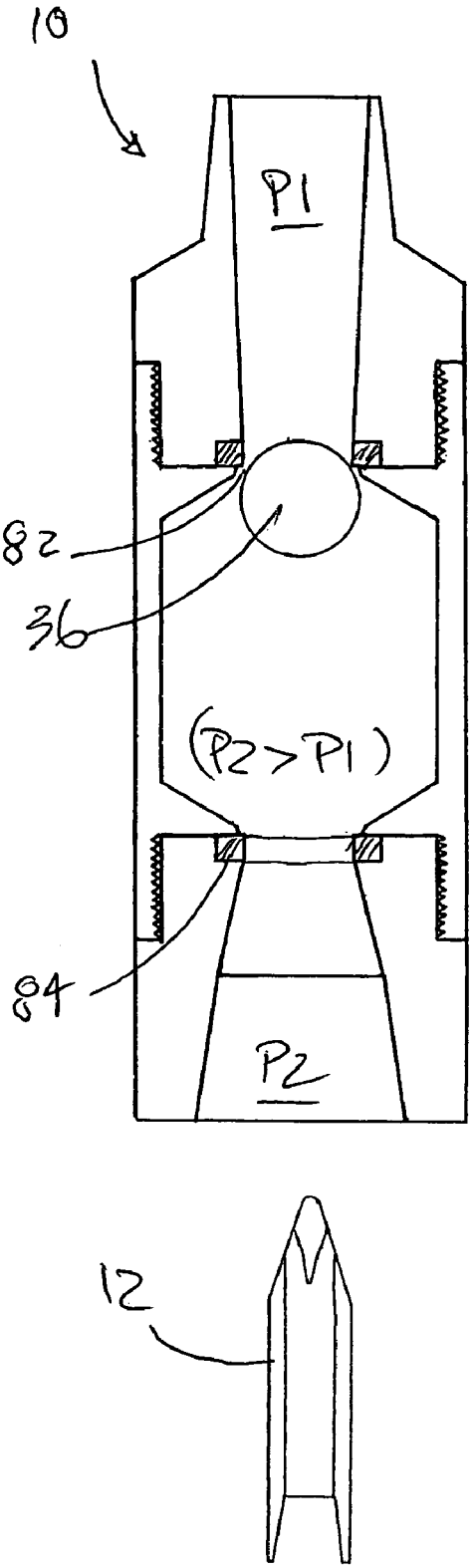
FIG. 7*b* is a cross-sectional view of the alternate embodiment of the valve of FIG. 7*a* indicating the ball on the upper ball seat and with a stab tool approaching from the bottom.

Additionally, it is recognized that the new valve 10 and stab tool 12 have other applications, including other orientations as shown in FIGS. 7*a*,7*b*. A ball seat 38 may be normally positioned at the upper end of the valve housing 44, or as shown, the valve housing 44 can be fit with both an upper ball seat 82 and a lower ball seat 84 for blocking flow in either direction. In situations where downhole pressure P2 exceeds uphole pressure P1, the ball 36 can seat on the upper ball seat. Using a downhole affixed stab tool 12 oriented similar to the projection 67 of FIG. 5*a*, then a ball 36 and an upper ball seat 82 can be bypassed as readily as a conventional lower ball seat case of a pump. Improved over the projection 67 of FIGS. 5*a*–5*e*, the stab tool 12 can unseat a ball 36 laterally rather than the limited action of the projection 67 which can only lift a conventional ball. Accordingly, regardless of the orientation of the valve 10, a stab tool 12 can be passed thereby and defeat the fluid block.

The embodiments of the invention in which an exclusive property or privilege is being claimed are detailed as follows:

1. A system for accessing the upstream end of a one-way valve comprising:

a stab tool; and wherein the one-way valve comprises a valve housing having bore, a ball seat at an upstream end and a ball within the bore downstream of the ball seat so that when the stab tool extends upstream into the valve, the stab tool unseats the ball from the ball seat and displaces the ball in the bore for enabling access of the stab tool the wrong way through the ball seat to the upstream end of the valve.

2. The system of claim 1 wherein the stab tool further comprises a nose, the nose being adapted to unseat the ball from the ball seat.

3. The system of claim 2 wherein the nose has a leading edge which narrows from the stab tool.

4. The system of claim 2 wherein the nose has a ball-unseating shape selected from the group consisting of a wedge, conical, concave curved, convex curved and combinations thereof.

5. The system of claim 1 wherein the valve is positioned in a wellbore, the system further comprising a conveyance means, the stab tool being attached to an end of the conveyance means for conveying the stab tool through the wellbore to the valve.

6. The system of claim 5 wherein the conveyance means is sized to pass through the ball seat of the valve.

7. The system of claim 4 wherein the conveyance means is tubing and wherein:

the stab tool has a fluid bore and ports therein; and the tubing has a fluid bore contiguous with the fluid bore of the stab tool for the flow of fluid to the stab tool and out of the ports.

8. The system of claim 1 further comprising a ball stop downstream of the ball for retaining the unseated ball in the valve, the ball stop sized to pass the stab tool.

9. The system of claim 1 wherein the valve is positioned in a wellbore and a fluid at the upstream end of the valve forms a hydrostatic head to form a pressure differential across the valve and wherein:

the hydrostatic head is relieved prior to unseating the ball.

10. The system of claim 9 wherein the hydrostatic head is relieved by injecting a low density fluid into the hydrostatic head.

11. The system of claim 10 wherein the low density fluid is injected into the hydrostatic head through the stab tool.

12. The system of claim 10 wherein the low density fluid is selected from the group consisting of air and foam.

13. A method to clear debris below one or more one-way valves having a ball seat and a ball, the method comprising:

conveying a stab tool on tubing to each of the one or more valves and at each valve;

unseating the ball from the ball seat with the stab tool;

passing the stab tool through the ball seat;

repeating the conveying, ball unseating and ball seat passing steps through each of the one or more valves;

conveying the stab tool to the debris; and circulating fluid through the tubing and through ports in the stab tool to below the one or more valves.

14. The method of claim 13 wherein the one or more one-way valves are traveling and standing valves of a reciprocating pump, the method comprising:

conveying the stab tool to the traveling valve;

unseating the ball from the ball seat and passing the stab tool through the ball seat;

conveying the stab tool to the standing valve;

unseating the ball from the ball seat and passing the stab tool through the ball seat;

circulating fluid through the tubing and through ports in the stab tool to clear the debris from below the reciprocating pump.

15. The method of claim 13 wherein the valve positioned in a wellbore and a fluid above the valve forms a hydrostatic head to form a pressure differential across the valve, the method further comprising:

relieving the hydrostatic head prior to unseating the ball.

16. The method of claim 15 wherein the hydrostatic head is relieved by injecting a low density fluid into the hydrostatic head.

17. The method of claim 16 wherein the low density fluid is injecting into the hydrostatic head through the tubing and through the ports in the stab tool.

18. The method of claim 16 wherein the low density fluid is selected from the group consisting of air and foam.

19. The system of claim 1 applied to a reciprocating pump for enabling flushing of fluid downhole therethrough further comprising:

a rod sandwiched between a reciprocating uphole valve and a stationary downhole valve, each of the uphole and downhole valve having a ball seat and a ball uphole of the ball seat;

the stab tool affixed at a lower end of the rod and a projection affixed at an upper end of the rod, means for temporarily suspending the rod below the uphole valve, the length of the suspended rod being such that during a pumping downstroke the stab tool does not engage the downhole valve and the projection does not engage the uphole valve, and during a closing downstroke which lowers the uphole valve a distance exceeding that of the pumping downstroke, the stab tool unseats the ball from the ball seat of the downhole valve and passing the stab tool therethrough to open the downhole valve; and the uphole valve lowers over the projection for lifting the ball from the ball seat of the uphole valve to open the uphole valve, so that fluid can be flushed downhole through the uphole valve and the through the downhole valve.

20. The system of claim 19 wherein the suspending means comprises a downhole limiting stop depending from the uphole valve.

21. The system of claim 20 further comprising a stop for arresting downhole movement of the rod once the stab tool has passed through the downhole valve so that further lowering of the uphole valve engages the projection and uphole valve.

22. A method to fluid bypass a reciprocating pump having a piston and a barrel, the method comprising:

providing a rod between a reciprocating uphole valve on the piston and a stationary downhole valve on the barrel, the rod having a stab tool at a lower end and a projection at an upper end, the rod being supportably movable relative to the uphole valve for supporting the rod from interfering with the uphole and downhole valves during a normal pumping downstroke; and lowering the piston below the normal pumping downstroke for forcing the stab tool through and bypassing the downhole valve, and supportably engaging the rod for forcing the projection upwards through and bypassing the uphole valve.

23. The method of claim 22 further comprising:

reverse circulating fluid through the uphole and downhole valves to fluidize debris below the pump.

24. The method of claim 22 wherein the lowering step further comprises:

lowering the piston a first distance below a normal pumping downstroke distance for forcing the stab tool through the downhole valve; and lowering the piston a second distance for engaging the rod with a stop for forcing the projection upwards through the uphole valve.

25. The method of claim 22 wherein the lowering step further comprises:

lowering the piston a first distance below a normal pumping downstroke distance for forcing the projection upwards through the uphole valve; and lowering the piston a second distance for forcing the stab tool through the downhole valve.

26. The method of claim 22 further comprising:

conveying tubing having a second stab tool attached thereto through the wellbore to the pump;

engaging the second stab tool with the uphole valve and passing therethrough;

conveying the stab tool past the rod; and engaging the second stab tool with the downhole valve and passing therethrough.

27. The method of claim 26 wherein using the conveying engaging and conveying steps:

circulating fluid through the tubing and through ports in the stab tool.

28. The method of claim 26 wherein a least during the engaging of the downhole valves step:

circulating fluid through the tubing and through ports in the stab tool to fluidize debris ahead of the stab tool.

* * * * *